US011217952B2

(12) United States Patent
Holzapfel

(10) Patent No.: US 11,217,952 B2
(45) Date of Patent: Jan. 4, 2022

(54) SLIP RING MODULE

(71) Applicant: Schleifring GmbH, Fürstenfeldbruck (DE)

(72) Inventor: Christian Holzapfel, Fürstenfeldbruck (DE)

(73) Assignee: Schleifring GmbH

( * ) Notice: Subject to any disclaimer, the term of this patent is extended or adjusted under 35 U.S.C. 154(b) by 206 days.

(21) Appl. No.: 16/385,986

(22) Filed: Apr. 16, 2019

(65) Prior Publication Data

US 2019/0245312 A1 Aug. 8, 2019

Related U.S. Application Data

(63) Continuation of application No. PCT/EP2017/077346, filed on Oct. 25, 2017.

(30) Foreign Application Priority Data

Oct. 25, 2016 (EP) ..... 16195609

(51) Int. Cl.
*H01R 39/08* (2006.01)
*H01R 39/26* (2006.01)
(Continued)

(52) U.S. Cl.
CPC ..... *H01R 39/08* (2013.01); *H01R 39/26* (2013.01); *H01R 43/10* (2013.01); *H01R 43/08* (2013.01)

(58) Field of Classification Search
CPC ..... H01R 43/10; H01R 39/08; H01R 39/46; H01R 39/26; H01R 39/39; H01R 39/64;
(Continued)

(56) References Cited

U.S. PATENT DOCUMENTS 2,961,385 A * 11/1960 McGall ..... H01R 43/10 205/122
2,967,283 A * 1/1961 Medney ..... C25D 7/04 439/85

(Continued)

FOREIGN PATENT DOCUMENTS

EP 0618648 10/1994

OTHER PUBLICATIONS

International Search Report and Written Opinion issued in International Patent Application PCT/EP2017/077346, dated Dec. 15, 2017, 15 pages.

*Primary Examiner* — Quyen P Leung
*Assistant Examiner* — Alexander A Singh
(74) *Attorney, Agent, or Firm* — Quarles & Brady, LLP; Yakov S. Sidorin

(57) ABSTRACT

A method for manufacturing a slipring module comprising a plurality of sliding tracks and an insulating body. The method includes:

making a monolithic sliding track component preferably by a 3D printing process. The monolithic sliding track component comprises a plurality of sliding tracks, multiple connector for electrically connecting the sliding tracks, and at least one strut for mechanically interconnecting the sliding tracks and the connector to form a monolithic sliding track component;

inserting the monolithic sliding track component into a mold;

filling the mold with an insulating material such as a plastic material, and curing the plastic material;

removing the molded product forming a slipring module from the mold, and removing the at least one strut from the slipring module.

20 Claims, 7 Drawing Sheets

(51) Int. Cl.
*H01R 43/10* (2006.01)
*H01R 43/08* (2006.01)

(58) Field of Classification Search
CPC ..... H01R 43/08; H01R 43/06; H01R 43/16; H01R 39/00; H01R 39/085; H01R 39/10; H01R 39/12; H01R 39/34; H01R 39/02; H01R 39/025; H01R 39/027; H01R 39/04; H01R 39/045; H01R 39/06; H01R 39/14; H01R 39/16; H01R 39/32; Y10T 29/49011; Y10T 29/49069; C25D 7/04
USPC ..... 29/597; 310/127, 128, 135, 136, 173, 310/232, 231, 233, 143, 147
See application file for complete search history.

(56) References Cited

U.S. PATENT DOCUMENTS

| | | | | | |
|---|---|---|---|---|---|
| 3,126,596 | A * | 3/1964 | Rector | H01R 39/00 29/860 |
| 3,182,217 | A | 5/1965 | Quinn | |
| 3,219,557 | A * | 11/1965 | Quintana | H01R 39/00 205/122 |
| 3,289,140 | A | 11/1966 | Slack | |
| 3,435,402 | A | 3/1969 | Smith | |
| 6,283,638 | B1 | 9/2001 | Feuer et al. | |
| 6,836,049 | B2 * | 12/2004 | Terada | H01R 43/08 310/233 |
| 9,209,572 | B1 | 12/2015 | Dunwoody | |
| 2004/0242025 | A1 | 12/2004 | Angerpointner et al. | |
| 2014/0084745 | A1 * | 3/2014 | Osawa | H02K 13/04 310/234 |

* cited by examiner

SLIP RING MODULE

CROSS-REFERENCE TO RELATED APPLICATIONS

This application is a continuation of the pending International Application No. PCT/EP2017/077346 filed on 25 Oct. 2017, which designates the United States and claims priority from the European Application No. 16195609.9 filed on 25 Oct. 2016. The disclosure of each of the above-identified patent applications is incorporated herein by reference.

BACKGROUND

1. Field of the Invention

The invention relates to sliprings and parts thereof. It specifically relates to slipring modules that include a plurality of individually prefabricated sliding tracks and a method of assembling slipring modules from plurality of individually prefabricated sliding tracks. Sliprings are used for transferring electrical signals or power between parts rotating relative to each other. Sliprings generally have circular tracks of an electrically-conductive material at a first part and brushes of an electrically conductive material at a second part. The brushes are sliding at the electrically-conductive tracks.

2. Description of Relevant Art

A slipring disclosed in U.S. Pat. No. 6,283,638 B1 comprises a cylindrical slipring module having cylindrical sliding tracks of a conductive material and brush blocks that include brushes configured to slide on the sliding tracks. The brush blocks (and therefore the brushes) are made rotatable against the module. The embodiment disclosed in this document specifically has wire brushes made of a comparatively thin metal wire. The sliding tracks of the module contain V-shaped grooves to guide the wire(s) at a predetermined position.

SUMMARY

The embodiments are providing a slipring module, which can be manufactured with a simple and straight forward manufacturing process, and which allows a large variety of module designs with different sliding track geometries.

In one embodiment, a sliding track component includes at least one sliding track and, preferably, a connector configured to electrically connect the sliding track made of (as) one piece. Accordingly, the sliding track component has a monolithic structure. This means at least that the sliding track component is formed as a single piece of the same material. This monolithic structure of the sliding track component is preferably made with a 3D printing process carried out with the use of a 3D printer. Such a 3D printing process may be a process that involves dissipating multiple layers of a material to generate a predetermined three-dimensional structure. Such processes may include the Electron Beam Melting (EBM), Laser-engineered Net Shaping (LEMS), Selective Laser Melting (SLM), and Selective Laser Sintering (SLS). The method of Electron Beam Melting includes a selective melting process, by which the 3D structure is built-up layer by layer using an electron beam in vacuum. A precursor material in this case is a metal powder. The positioning of the electron beam is controlled with software according to the desired design (such software control based on 3D CAD design data is an intrinsic property of all modern additive manufacturing processes).

For Laser-engineered Net Shaping, a high-power laser beam is applied to the target material. The metallic powder (made of pure metal or alloy(s)) is deposited by using a nozzle locally at a desired location that is determined according to the 3D structure, and subsequently melted by the laser beam. The elements of deposited material are formed in lines, in form of a raster process for each layer. This method can be used as an additive manufacturing process to generate new parts as well as for various repair actions.

In selective laser sintering, a laser used to generate heat at specific positions within a powder material. The heat generation then leads to sintering of the material at a given specific position and, hence, solidification and formation of a spatially-continuous complex structure.

For selective laser melting process, a laser is used to achieve complex 3D designs. However, in this case the laser energy is used to cause melting of the metal powder (rather than just sintering). In the majority of cases, a single laser output is utilized, although a double-beam technology exists that combines the output of a lower- and higher-power laser outputs to generate complex spatial patterns.

Preferably, a 3D printed structure of an embodiment is a structure comprising a plurality of thin material layers that are molded, sintered, and/or processed with any other electrical thermal or chemical process to form a monolithic body from these thin material layers. Preferably, the used material is a metal, an electrically conductive material, or a metallic material that possesses good electrical characteristics and that is able to guide electrical current. The material of choice may additionally be defined to possess good contacting and/or good mechanical/frictional and/or good wear characteristics, in order to ensure that a fabricated from this material sliding surface (on which a sliding brush may slide) has a long lifetime and good contact characteristics (such as, for example, low contact noise and low contact resistance).

The connector may be a connector for plug and/or socket connection, soldering connection, or screw connection. The connector may further have a connecting line section, defined between the sliding track and an external connecting point for external electrical connection.

In a related embodiment, a sliding track component may include at least two sliding tracks. The sliding track may further include at least one connector.

Preferably, a sliding track of an embodiment is structured as a hollow cylindrical or ring-shaped body defining an outer side, an inner side, and a center axis about which the slipring may later be rotated.

A sliding track preferably has a contact surface configured to be contacted by a sliding brush (such as a wire brush or a carbon brush, for example). The sliding track is further formatted to have a surface opposite to the contact surface (an opposite surface) and two side surfaces. There exist two basic slipring geometries. The first is a drum-type geometry, and the second is a platter or disk-type geometry. When the slipring is of a drum type, the sliding tracks are preferably arranged co-axially with the rotation axis, while the slipring module has a cylindrical or drum-like shape with the sliding tracks having their contact surfaces or sliding surfaces at the outside of the cylindrical drum. When the slipring is of a disk type, the sliding tracks are arranged radially with respect to an axis of rotation, and the sliding surfaces of all sliding tracks are preferably pointing in the same direction.

Preferably, at least one connector is connected at a side that is opposing the contact surface. In a drum-type configuration of the sliding track, the connector preferably protrudes from the inner side of the ring-shaped sliding track in a direction parallel to the center axis, but outside of the center axis. In a disk-type sliding track, the connector preferably protrudes from the inner side of the ring in a radial direction. Preferably the connector has an elongated shape, most preferably a shape of a rod.

Preferably, each sliding track has at least one connector. There may be two or more connectors at a single sliding track to improve the electrical connection and to lower the ohmic resistance. In a related embodiment, it may also be possible to employ a single connector to contact multiple sliding tracks, but this may not be desirable in most applications, as such arrangement may cause a short circuit between the sliding tracks.

Another embodiment includes a sliding track component having a plurality of sliding tracks and, preferably, connectors that are further interconnected with at least one strut. Preferably, the struts are at the inner side of the sliding tracks. The struts preferably are interconnected with each other and with the sliding tracks. The ring-shaped sliding tracks, the connectors, and the struts form a monolithic piece, which includes a 3D printed structure and which preferably has been made with the use of a 3D printer. Basically, a strut forms a mechanical connection between two parts (for example, between sliding tracks).

Preferably, fracture points/locations are provided between the struts and the sliding tracks and/or the connectors, such that the struts may be removed at a later time.

In yet another embodiment, the sliding track component includes at least one sliding track and at least one connector that form one single piece of a 3D printed material. In such embodiment, the use of at least two different 3D printing materials are required. A first 3D printing material possesses metallic conductive characteristics and is used for transmitting the electrical current. This material is used for manufacturing the sliding tracks and the connectors. A second 3D material is used for making the insulating material parts and, therefore, is chosen to have electrically-insulating properties. (Here, a plastic material may be used. Such a plastic material may be epoxy, polyurethane or any other suitable material, as well as combination of such materials with fillers or other materials.) As a result of printing the whole, complete slipring module in a single printing process, the need to provide the above-mentioned struts for forming a stiff monolithic structure is no longer present.

In one embodiment, at least one sliding track has a holding structure which may later provide a form-fit with an insulating body to increase the mechanical stability and to firmly hold the sliding track and the insulating body together. The holding structure may include protrusions and/or recesses. In one embodiment, there may be present at least one protrusion and/or recess at opposing sides of the sliding track and distant from the sliding surface. In a related embodiment, there may be present at least one holding protrusion extending from a side that is distant with respect to the contact side of the sliding track.

In a further embodiment, at least one sliding track may have at least one V-groove or a plurality of V-grooves, or any other appropriately structured profile form that facilitates the guidance of contact brushes and/or reduces wear and friction of the brushes upon the sliding. In a further embodiment, at least one sliding surface has a microstructure configured to increase contacting performance. Preferably, such a microstructure is manufactured with a 3D printing process.

A further embodiment relates to a method of manufacturing a slipring module. The method includes the steps of making a monolithic sliding track component preferably by a 3D printing process. The monolithic sliding track component includes at least one sliding track and at least one connector configured to electrically connect the sliding track;

inserting at least one of the monolithic sliding track components into a mold;

filling the mold with an insulating material such as a plastic material, and curing the plastic material;

removing the molded product forming a slipring module from the mold.

A further embodiment includes the steps of:

making a monolithic sliding track component preferably by a 3D printing process. The monolithic sliding track component includes at least two sliding tracks, at least one connector configured to electrically connect each of the sliding tracks, and at least one strut configured to mechanically connect the sliding tracks and the connector to form a monolithic sliding track component;

inserting at least one of the monolithic sliding track components into a mold;

filling the mold with an insulating material such as a plastic material, and curing the plastic material;

removing the molded product forming a slipring module from the mold;

removing the at least one strut from the slipring module.

Although the embodiment explained above relates to the cylindrical or drum-shaped slipring modules, disk-shaped or platter modules may be manufactured in the same way, by using a 3D printing process on a 3D printer.

There may be a finishing process of the module, which process may include the step(s) of coating or plating at least one sliding surface and/or machining at least one sliding surface to form a specific bare-surface structure such as V-grooves, or to generate a specific surface roughness. Coating or plating of such initially bare (that is, lacking any coating) surface may be additionally carried out with galvanic deposition, PVD or CVD, or any other suitable fabrication methodology.

The embodiments disclosed below provide significant improvements over the prior art. Now, slipring modules can be manufactured easily by using a monolithic sliding track component and at least partially embedding the same into an insulating material (such as a plastic material). This results in a mechanically robust slipring module structure, because the monolithic sliding track component is present in only one, single piece that contains multiple sliding tracks together with their corresponding electrical connectors and a holding structure (comprising at least one strut and preferably comprising a main support unit that may be configured to hold or connect the struts). Such a monolithic sliding track component may easily be manufactured via 3D printing, as has been already mentioned above, resulting in a simple and straightforward manufacturing methodology that includes 3D printing the monolithic sliding track component, inserting the monolithic sliding track component into a mold, filling insulating material into the mold, and curing the insulating material to form the insulating body. After at least one partial curing of the insulating material, the mold may be removed. Finally, the struts and/or the main support are removed to procure the finished slipring module.

Yet another embodiment relates to monolithic brush holder, which preferably is made by a 3D printing process by a 3D printer as mentioned above. The brush holder preferably includes a brush holder body that has at least one brush contact. There may be present at least a second brush contact. The brush contacts establish a contact with and/or hold at least one brush wire. Generally, any number of brush contacts and/or brush wires may be present. Preferably, the brush contacts are oriented such that the brush wire extends from the brush holder body at a certain angle that is different from 90°, to apply the desired pressure to a sliding track. Electrical contact(s) between the brush wires and the brush holder body may be established by crimping, soldiering, welding, or any other suitable method. There may be a threaded hole or any other appropriate means for mounting and/or electrically contacting the brush holder. Multiple brush holders may be assembled into a brush block. This embodiment may be operably combined or cooperated with at least one of the embodiments mentioned above.

BRIEF DESCRIPTION OF THE DRAWINGS

In the following, the invention is described with the use of non-limiting examples of embodiments and with reference to the drawings, of which.

Embodiments of the invention can be variously modified and assume alternative forms. It should be understood that the drawings and the corresponding detailed description are not intended to limit the invention to the any particular disclosed forms but to the contrary, the scope of the intention is intended to cover all modifications, equivalents, and alternatives falling within the spirit and scope of the present invention as defined by the appended claims.

DETAILED DESCRIPTION

Figure 1:
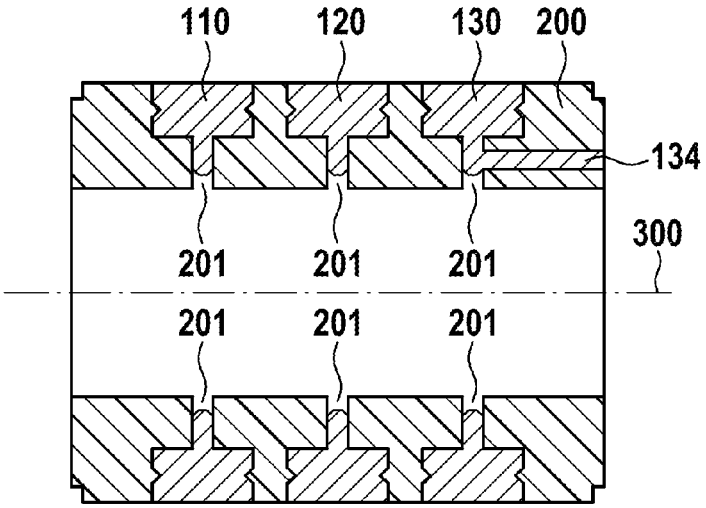
FIG. 1 is a sectional view of a slipring module configured according to a first embodiment.

In FIG. 1, a slipring module according to a first embodiment is shown in a sectional view. At least one sliding track 110, 120, 130 is at least partially embedded into an insulating body 200. (Although this embodiment shows three sliding tracks, there is no limitation on the number of sliding tracks. A simple module may include only one sliding track, whereas complex modules may include a large number of sliding tracks.) The sliding tracks shown here are of the same size, but sliding tracks of different sizes may be combined in a single module. The sliding tracks may have different widths, different thicknesses, or even different diameters. There may be present at least one connector 134 that is connected to at least one sliding track (130, as shown). Most preferably, the connector is embedded into the insulating material 200. There may be additional connectors cooperated with the other sliding tracks. (In this implementation, such additional connectors may be provided for sliding tracks 110 and 120, but they are not shown in this sectional view, as they are embedded into the insulating body 200.) The slipring module has a rotation axis 300, which most preferably is the same axis as the center axis of the individual sliding tracks 110, 120, 130. In other words, in the preferred implementation the sliding tracks are co-axial with the rotation axis of the slipring module.) Preferably, the sliding tracks and connectors shown herein are monolithic, single-piece components. The monolithic structure of the sliding track components is preferably made via 3D printing with the use of a 3D printer. Such a 3D printing process may be a process of dissipating multiple layers of a material to generate a predetermined three-dimensional structure. Such process may include at least one of the EBM, LEMS, SLM, SLS.

Figure 2:
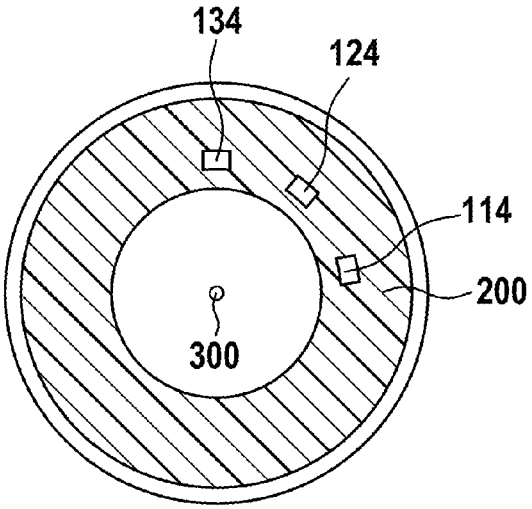
FIG. 2 shows a side view of the first embodiment.

In FIG. 2, a sectional side view of the first embodiment of FIG. 1 is shown. Here, the front ends of connectors 114, 124, and 134 (corresponding, respectively, to the sliding tracks 110, 120, 130) can be seen extending through the insulating body 200.

Figure 3:
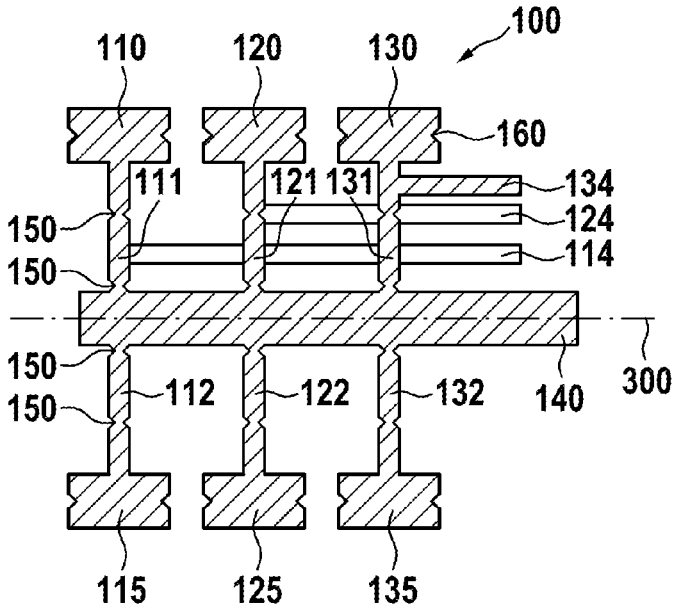
FIG. 3 shows a monolithic sliding track component.

In FIG. 3, a monolithic sliding track component 100 according to a first embodiment is shown. The first 110, second 120 and third 130 sliding tracks (having first sliding surface 115, second sliding surface 125 and third sliding surface 135, respectively) are held in a fixed spatial relationship with the first and second struts 111, 112 of the first sliding track 110, first and second struts 121, 122 of the second sliding track 120, and first and second struts 131, 132 of the third sliding track 130. These struts are further held with a main support 140 (which may for example be configured as a rod extending along the rotation axis 300). Furthermore, there is at least first, second and/or third connectors 114, 124, 134 configured to electrically connect the sliding tracks. In one embodiment, at least one fracture point or element or feature 150 is formed at least one of the struts, to allow for separation of the struts from the sliding tracks at the location of the fracture element, to avoid electrical short circuiting. The connectors 114, 124, 134 may be connected to a given sliding track at any point, as long as such connection(s) provide good electrical contact. For example, as shown the connector 134 is connected to the sliding track 130 at an upper section of the first strut 131. In another example, the connectors 114 and 124 are connected directly to the corresponding sliding tracks to provide a spatial offset(s) from the connector 134. In one embodiment, at least one of the sliding tracks (and most preferably all sliding tracks) is equipped with a holding structure 160, preferably at the side of the corresponding sliding track. In one embodiment, there is a symmetrical arrangement of the holding structures at the sliding tracks to evenly distribute the holding forces. In reference to FIGS. 1 and 12, and depending on the specifics of a particular implementation, such holding structure 160 may include recesses 201 and/or protrusions 161. In the example of FIG. 3, the holding structure 160 includes a V-shaped recess (groove). During the molding process, the insulating material (e.g. a plastic material) flows into this V-shaped recess or any other holding structure, and forms a form-fit to hold the sliding track in place.

Figure 4:
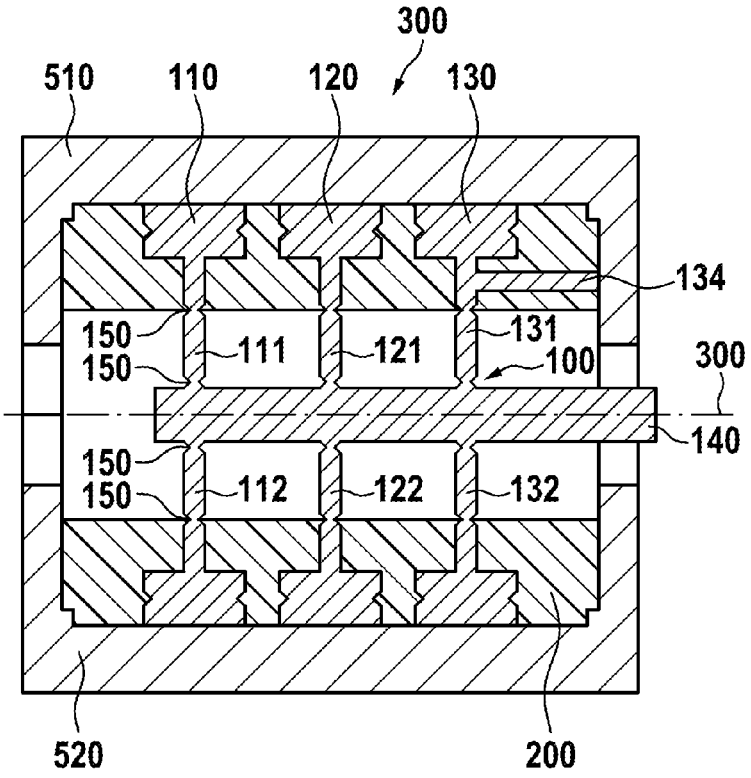
FIG. 4 shows a sectional side view of the monolithic sliding track component.

In FIG. 4, a sectional side view of the monolithic sliding track component is shown in a mold after the mold has been filled with an insulating material (e.g. a plastic material) forming the insulating body 200. Preferably, the mold is a two-sectioned cylindrically-shaped body having a first section 510 and a second section 520.

Figure 5:
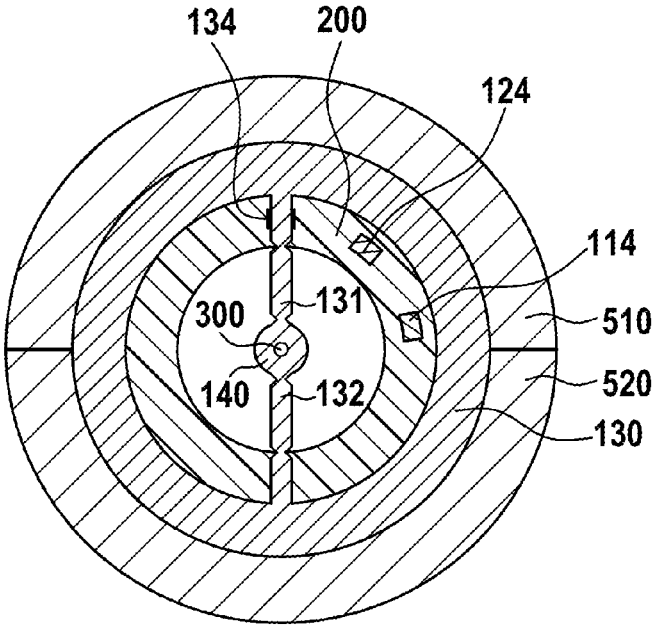
FIG. 5 shows a front view of the monolithic sliding track component.

In FIG. 5, a front view of the monolithic sliding track component is shown, with a cross-section through the center of the third sliding track 130. FIG. 5 also clearly shows the arrangement of the struts 131 and 132. The other struts 111, 121, 112, 122 are not visible in this view because they are hidden (blocked from view) by the struts 131 and 132.

Figure 6:
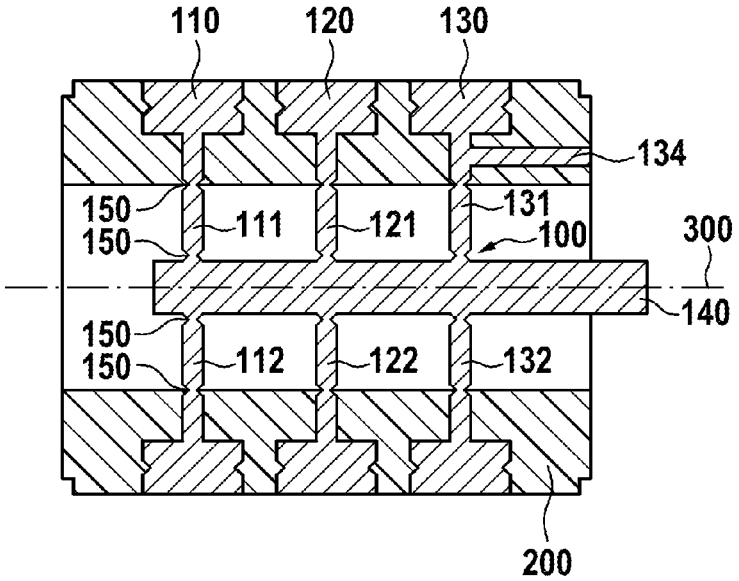
FIG. 6 illustrates the slipring module after it has been removed from the mold.

In FIG. 6, an embodiment of the slipring module is shown in a sectional view after it has been removed from the mold 500. Now, an insulating body 200 is formed by the insulating material, e.g. a cured plastic material. Before using the slipring module, the struts and the main support 140 have to be removed to avoid short-circuiting of the sliding tracks. This may easily be done by moving the main support 140 into the direction of the rotation axis 300. Such movement, when implemented, would bend the struts and cause the struts to break at the fracture points 150 of the main support 140 and the sliding tracks. The appropriate movement may easily be carried out by pushing or knocking a bolt against the main support 140 or by pushing the slipring module with its main support 140 on a flat surface) with the main support extending over one side of the slipring module as shown).

Before removing the struts and the main support from the mold, any tests or modification may be done which require an electrical connection of the sliding tracks. For example, a common electrical test may be performed, or the sliding tracks may be galvanized or anodized, for which the main support may be a common electrode connection.

Figure 7:
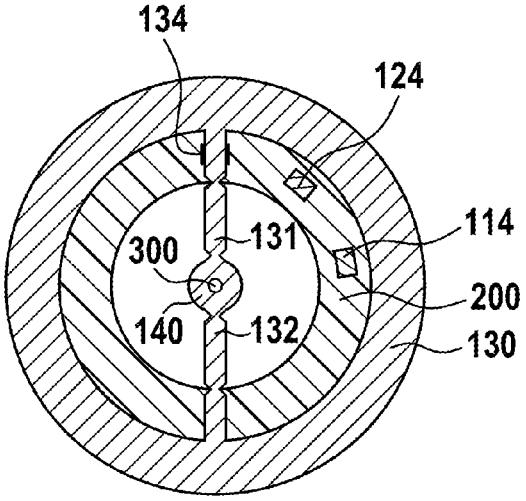
FIG. 7 shows a side view of the monolithic sliding track component.

In FIG. 7, a side view of an embodiment of the monolithic sliding track component is shown, with a cross-section through the center of the third sliding track 130. FIG. 7 also clearly shows the arrangement of the struts 131 and 132. The other struts 111, 121, 112, 122 are not visible because they are hidden (blocked from view) by the struts 131 and 132.

Figure 8:
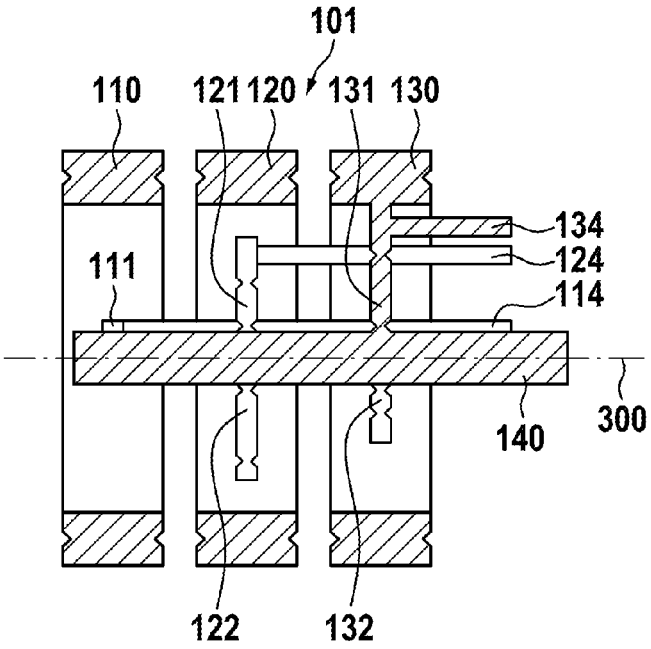
FIG. 8 shows a related embodiment of the invention.
Figure 9:
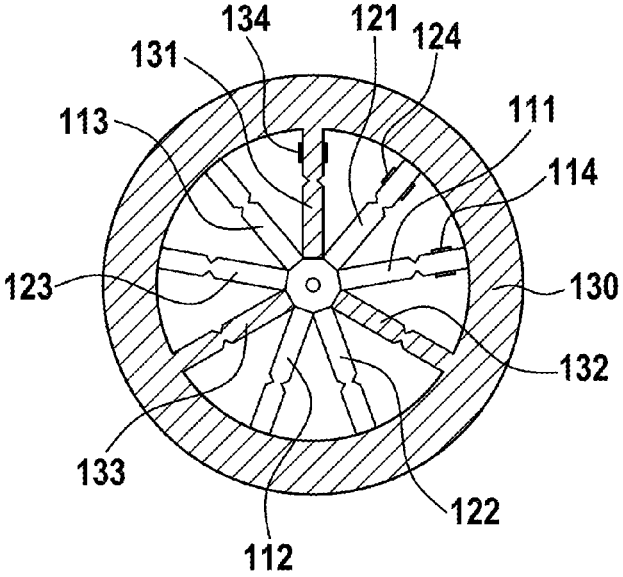
FIG. 9 shows a sectional front view through a section of the sliding track.

In FIG. 8, a related embodiment of the monolithic sliding track component 101 is shown. In this embodiment, the struts have a different design than in the previous embodiment. Whereas in the previous embodiment only two struts were used to hold/affix a sliding track to the main support, in the embodiment of FIG. 8 three struts are used for the same purpose. Structural details of the struts can be appreciated from the following FIG. 9, which shows a front cross-sectional view drawn through the sliding track 130. In this embodiment, first sliding track 110 is held by the first strut 111, second strut 112, and third strut 113, which are only shown in FIG. 9. There is connector 114 configured to electrically connect the first sliding track 110 to another component. A second sliding track 120 is held by the first strut 121, second strut 122, and third strut 123, which is also shown in FIG. 9. Furthermore, a connector 124 is provided and configured to connect the second sliding track 120. Third sliding track 130 is held by a first strut 131, a second strut 132, and a third strut 133, which is shown in FIG. 9. A connector 134 is provided and configured to connect the first sliding track 130.

In FIG. 9, a cross-sectional front view through a section of the sliding track 130 is presented. FIG. 9 shows all the struts configured to hold the sliding tracks. In this embodiment, there exist three struts per sliding track, each strut extending along an axis at 120 degrees with relation to that of the neighboring strut.

Figure 10:
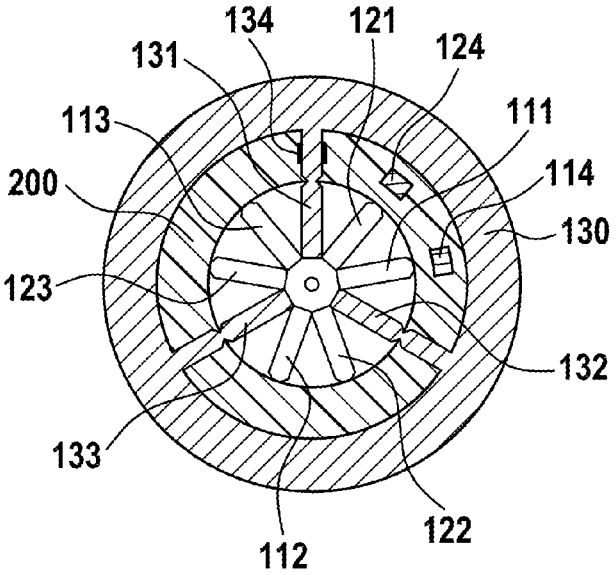
FIG. 10 shows a side view of the molding.

In FIG. 10, a side view of the molded module is shown. Here, portions of the struts are shown embedded into the insulating material 200.

Figure 11:
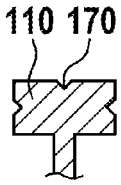
FIG. 11 depicts a specific embodiment of a sliding track.

In FIG. 11, a specific embodiment of a sliding track is shown with a V-groove 170 at its sliding surface.

Figure 12:
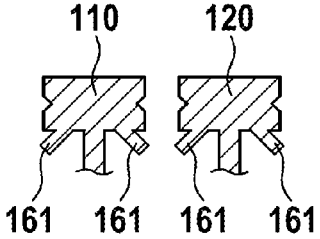
FIG. 12 illustrates sliding tracks with holding protrusions.

FIG. 12 illustrates sliding tracks with holding protrusions 161 extending from the inner side of the sliding tracks. Such holding protrusions are later (during the fabrication process) embedded into the insulating body material 200 to firmly hold the sliding tracks in place.

Figure 13:
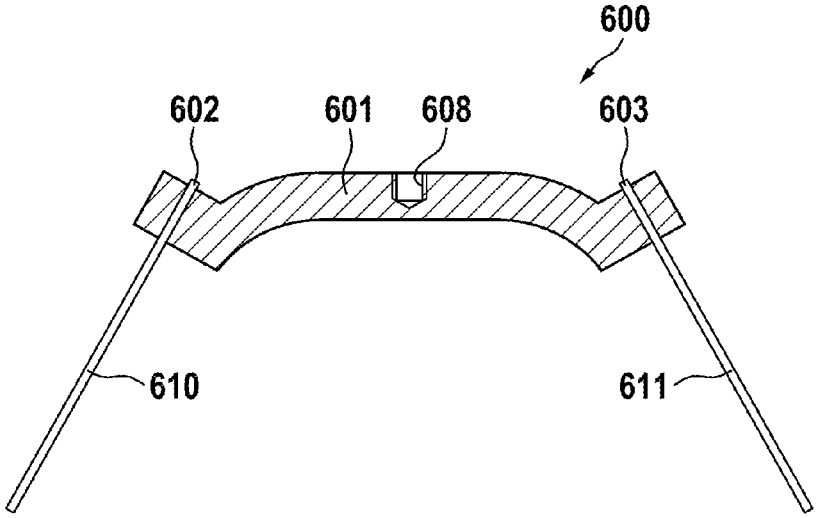
FIG. 13 presents a brush block.

In FIG. 13, a brush holder 600 is shown as a monolithic, single-piece component, which most preferably is made by a 3D printing process by a 3D printer as mentioned above. The brush holder 600 includes a brush holder body 601 that has at least a first brush contact 602 and a second brush contact 603. The brush contacts establish contact(s) with and/or hold at least a first brush wire 610 and/or a second brush wire 611. Generally, there may be any number of brush contacts and/or brush wires. Preferably, the brush contacts are oriented such, that the brush wire extends the brush holder body at a certain angle that is different from 90° to provide desired pressure to a sliding track, in operation. Electrical contact between the brush wires and the brush holder body may be established by crimping, soldiering, welding or any other suitable method. There may be a threaded hole 608 or any other means configured to mount and/or electrically contact the brush holder. Multiple brush holders may be assembled to a brush block. This embodiment may be combined with at least one of the embodiments mentioned above.

It will be appreciated to those skilled in the art having the benefit of this disclosure that this invention is believed to provide slipring modules. Further modifications and alternative embodiments of various aspects of the invention will be apparent to those skilled in the art in view of this description. Accordingly, this description is to be construed as illustrative only and is provided for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be re-versed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 monolithic sliding track component
101 monolithic sliding track component
110 first sliding track
111 first strut
112 second strut
113 third strut
114 first connector
115 first sliding surface
120 second sliding track
121 first strut
122 second strut
123 third strut
124 second connector
125 second sliding surface
130 third sliding track
131 first strut
132 second strut
133 third strut
134 third connector
135 third sliding surface
140 main support
150 fracture point
160 holding structure
161 holding protrusion
170 V-groove

200 insulating body
201 recess
300 rotation axis
500 mold
510 first mold section
520 second mold section
600 brush holder
601 brush holder body
602 first brush contact
603 second brush contact
608 threaded hole
610 first brush wire
611 second brush wire

The invention claimed is:

1. A monolithic sliding track component comprising:

a plurality of sliding tracks, each shaped as a hollow cylinder having an outer side, an inner side, and a center axis, a plurality of struts, each strut of said plurality of struts corresponding to a different sliding track of the plurality of sliding tracks and attached to an inner side of said different corresponding sliding track, and comprising at least one fracture element between at least one of (1a) a first strut and a second strut, (1b) a strut of the plurality of struts and a sliding track of the plurality of sliding tracks; and (1c) a strut of the plurality of struts and at least one connector that in electrical contact and in monolithic mechanical contact with at least one of the sliding tracks of the plurality of sliding tracks, wherein the first strut corresponding to a first sliding track and the second strut corresponding to a second sliding track are monolithically connected with one another such that said first and second sliding tracks of the plurality of sliding tracks are monolithically interconnected through and with said first and second struts to be held in a fixed spatial relation, wherein the monolithic sliding track component includes a metal or an electrically conductive material.

2. The monolithic sliding track component according to claim 1, comprising a plurality of layers that have been molded, sintered, or thermally connected together.

3. The monolithic sliding track component according to claim 1, comprising at least one connector that is in electrical contact and in monolithic mechanical contact with at least one of the sliding tracks, the at least one connector extending parallel to the center axis aside from the center axis.

4. The monolithic sliding track component according to claim 1, wherein struts from said plurality of struts form multiple groups of struts, each group of struts containing multiple struts and respectively corresponding to a different sliding track of the plurality of sliding tracks, a first group of struts containing said first strut, a second group of struts containing said second strut.

5. The monolithic sliding track component according to claim 4, wherein each of the first strut and the second strut comprises a respectively-corresponding fracture element at a respectively-corresponding end of each of the first and second strut that is distal to the respectively-corresponding sliding track from the plurality of sliding tracks.

6. The monolithic sliding track component according to claim 1, wherein at least one of the sliding tracks of the plurality of sliding tracks comprises at least one holding structure that includes at least one of a recess formed on a surface of said at least one of the sliding track that faces a neighboring sliding track, and a protrusion formed on a radially inner surface of said at least one of the sliding tracks.

7. The monolithic sliding track component according to claim 1, wherein at least one of the sliding tracks of the plurality of siding tracks comprises a sliding surface that is coated or plated or bare.

8. The monolithic sliding track component according to claim 1, wherein at least one of the sliding tracks of the plurality of sliding tracks comprises at least one V-groove formed in a sliding surface of said sliding track from the plurality of sliding tracks.

9. The monolithic sliding track component according to claim 1, further comprising a main support component extending co-axially with the center axis, wherein each of said first and second struts directly and monolithically radially connects a respectively corresponding sliding track from the plurality of sliding tracks to the main support component.

10. The monolithic sliding track component according to claim 9, wherein the main support component is a rod oriented along the center axis.

11. A slipring module comprising an insulating body and the monolithic sliding track component according to claim 1, wherein the monolithic sliding track component is at least partially embedded into the insulating body.

12. A method for manufacturing the slipring module according to claim 11, the method comprising the steps of:

fabricating said monolithic sliding track component;

inserting said monolithic sliding track component into a mold;

filling the mold with an electrically-insulating material, and curing the electrically-insulating material to form a molded product;

removing the molded product from the mold;

removing at least one strut from the molded product to procure the slipring module.

13. The method according to claim 12, wherein the fabricating the monolithic sliding track component includes 3D-printing said monolithic sliding track component.

14. The method according to claim 12, wherein said fabricating includes fabricating a main support component configured to mechanically connect struts from the plurality of struts, the method further comprising the step of:

removing the main support from the molded product after the molded product has been removed from the mold.

15. The method according to claim 12, further comprising:

processing a sliding track of the plurality of sliding tracks by performing at least one of a) coating; b) plating: and c) machining said sliding track of the plurality of sliding tracks to finish a sliding surface of the sliding track, said processing being performed either before said inserting the monolithic sliding track component into the mold or after said removing the molded product from the mold.

16. A monolithic sliding track component comprising:

a plurality of sliding tracks, each shaped as a hollow cylinder having an outer side, an inner side, and a center axis, a plurality of struts, each strut of said plurality of struts corresponding to a different sliding track of the plurality of sliding tracks and attached to an inner side of said different corresponding sliding track, wherein a first strut corresponding to a first sliding track and a second strut corresponding to a second sliding track are monolithically connected with one another such that said first and second sliding tracks of the plurality of sliding tracks are monolithically interconnected through and with said first and second struts to be held in a fixed spatial relation, wherein struts of said plurality of struts form multiple groups of struts, each group of struts containing multiple struts and respectively corresponding to a different sliding track of the plurality of sliding tracks, a first group of struts containing said first strut, a second group of struts containing said second strut, wherein each of the first strut and the second strut comprises a respectively-corresponding fracture element at a respectively-corresponding end of each of the first and second strut that is distal to the respectively-corresponding sliding track from the plurality of sliding tracks, wherein the monolithic sliding track component includes a metal or an electrically conductive material.

17. The monolithic sliding track component according to claim 16, comprising at least one connector that is in electrical contact and in monolithic mechanical contact with at least one of the sliding tracks, the at least one connector extending parallel to the center axis aside from the center axis.

18. The monolithic sliding track component according to claim 16, wherein at least one of the sliding tracks of the plurality of sliding tracks comprises at least one holding structure that includes at least one of a recess formed on a surface of said at least one of the sliding tracks that faces a neighboring sliding track, and a protrusion formed on a radially inner surface of said at least one of the sliding tracks.

19. A slipring module comprising an insulating body and the monolithic sliding track component according to claim 16, wherein the monolithic sliding track component is at least partially embedded into the insulating body.

20. A method for manufacturing the slipring module according to claim 19, the method comprising the steps of:

fabricating said monolithic sliding track component;

inserting said monolithic sliding track component into a mold;

filling the mold with an electrically-insulating material, and curing the electrically-insulating material to form a molded product;

removing the molded product from the mold;

removing the at least one strut from the molded product to procure the slipring module.

* * * * *